US009920497B2

(12) United States Patent
Yermolayev

(10) Patent No.: US 9,920,497 B2
(45) Date of Patent: Mar. 20, 2018

(54) SHOCK ABSORBING AND TRANSFERRING APPENDAGE

(71) Applicant: Domenique Collins Yermolayev, Saratoga Springs, NY (US)

(72) Inventor: Domenique Collins Yermolayev, Saratoga Springs, NY (US)

( * ) Notice: Subject to any disclaimer, the term of this patent is extended or adjusted under 35 U.S.C. 154(b) by 241 days.

(21) Appl. No.: 15/062,885

(22) Filed: Mar. 7, 2016

(65) Prior Publication Data

US 2017/0067217 A1 Mar. 9, 2017

Related U.S. Application Data

(60) Provisional application No. 62/215,850, filed on Sep. 9, 2015.

(51) Int. Cl.

| | |
|---|---|
| ***A01B 1/00*** | (2006.01) |
| ***E01H 5/02*** | (2006.01) |
| ***E01H 5/06*** | (2006.01) |

(52) U.S. Cl.

CPC ..... *E01H 5/02* (2013.01); *E01H 5/062* (2013.01)

(58) Field of Classification Search

CPC ..... E01H 5/02; E01H 5/062; B25J 19/0091

USPC ..... 294/56, 49, 54.5, 59; 37/196–285; 267/136–141.7

See application file for complete search history.

(56) References Cited

U.S. PATENT DOCUMENTS

| | | | | |
|---|---|---|---|---|
| 366,099 | A * | 7/1887 | Hinchman | E01H 5/02 294/56 |
| 405,407 | A * | 6/1889 | Goldman | A21B 3/003 294/56 |
| 661,287 | A * | 11/1900 | Crago | A01B 1/02 294/56 |
| 931,838 | A * | 8/1909 | Beehler | E01H 5/02 294/54.5 |
| 967,270 | A * | 8/1910 | Tiedt | E01H 5/02 294/54.5 |
| 1,042,352 | A * | 10/1912 | Kohler | E01H 5/02 294/54.5 |
| 1,181,135 | A | 5/1916 | Harrison | |
| 4,589,498 | A | 5/1986 | Wetmore | |
| 7,503,602 | B1 * | 3/2009 | Hinton | B60R 19/18 267/139 |
| 7,581,771 | B2 | 9/2009 | Rosine et al. | |
| 2008/0263907 | A1 * | 10/2008 | Winter | E01H 5/066 37/270 |
| 2009/0044433 | A1 * | 2/2009 | Hughes | E01H 5/062 37/266 |

OTHER PUBLICATIONS

Razaq Bin Maun, run flat tires, Dec. 2, 2014, p. 23, http://coontinentall.blogspot.com/2014/12/run-flat-tires.html (Year: 2014).*

* cited by examiner

*Primary Examiner* — Gabriela M Puig
(74) *Attorney, Agent, or Firm* — Dunlap Bennett & Ludwig PLLC; Brendan E. Squire

(57) ABSTRACT

An appendage or apparatus attached to the leading edge of a shovel for the purpose of small shock absorption from contact between paved roadways and the shovel. The invention aims to prevent the most basic fissures and cracks at contact with the roadway without complicated devices and can be retrofitted onto existing shovels.

18 Claims, 4 Drawing Sheets

SHOCK ABSORBING AND TRANSFERRING APPENDAGE

CROSS-REFERENCE TO RELATED APPLICATION

This application claims the benefit of priority of U.S. provisional application No. 62/215,850, filed Sep. 9, 2015, the contents of which are herein incorporated by reference.

BACKGROUND OF THE INVENTION

The present invention relates to shovels and, more particularly, to a shock absorption and transferring appendage for a shovel blade, and more particularly to snow shovel blades.

Roadbed fissures and potholes can be caused by the rupturing or cracking of pavement due to excess energy between the vertical and horizontal movements of a shovel, such as a snow plow, on or towards the ground. Additionally, water infiltration into a small fissure already present in a road surface and subsequent expansion as the water reaches near freezing temperatures can cause the surface of a roadway to buckle or rupture. When the blade of a snowplow or shovel makes contact with the ground, the shearing stress impacts these ruptures and can scrape away large portions of the roadway.

Other devices that are modifications to the shovel, or a snowplow include flaps, fan mechanisms, and shock absorbers in other areas of the shovel. These modifications do little for alleviating roadway damage and pothole formation due to the direct contact between the shovel and the road during roadway shoveling. Additionally the common method for treatment for fissures and potholes are post fact: happening after the incident occur.

As can be seen, there is a need for an improved attachment to a shovel blade to prevent the most basic fissures and cracks at contact without complicated devices and may easily be retrofitted onto existing shovels.

SUMMARY OF THE INVENTION

In one aspect of the present invention, an impact absorbing appendage, comprises: an elongate housing having a cavity defined therein; a plurality of weights disposed within said cavity; and a plurality of links interconnecting said plurality of weights. The appendage may also include a channel defined in an outer surface of the elongate housing and extending along a longitudinal length of the housing. Alternatively, a flange may extend from an outer surface of the elongate housing and along a longitudinal length of the housing. The appendage may also comprise an appendage extension at a first end and a second end of the elongate housing, extending upwardly from the elongate housing. In some embodiments, the channel extends from the elongate housing along an inward face of the appendage extension. The impact absorbing appendage may further comprise an interlink media contained within the cavity. The interlink media may include one of: a viscous fluid, a granular, a crushed, or a pelletized solid material.

In other aspects of the invention an impact absorbing apparatus for a shovel blade, comprises: an elongate housing having a cavity defined therein; a shock absorbing media contained within said cavity; an attachment flange extending along a longitudinal length of the appendage. In some embodiments, the attachment flange defines a channel extending along the longitudinal length of the appendage.

The shock absorbing media may comprise a plurality of weights disposed in a spaced apart relation within said cavity along a longitudinal length of the elongate housing. A plurality of links may be provided to flexibly interconnect the plurality of weights. The impact absorbing apparatus may also include a left and a right extension connected with the channel extending along inward opposed faces of the left and the right extensions and adapted to receive a left and a right lateral edge of the shovel blade. In some embodiments, the shock absorbing media comprises a viscous fluid. In other embodiments, the shock absorbing media comprises one of a granular, a crushed, or a pelletized solid material. The elongate housing is formed of a resilient material. In certain aspects of the invention, a fastener secures the elongate housing to the shovel blade.

Yet another aspect of the invention includes an impact absorbing shovel that comprises: a shovel blade having a leading edge; an appendage operatively coupled to the leading edge, the appendage comprising, an elongate resilient housing having a cavity defined therein; and a shock absorbing media contained within said cavity. In some embodiments, the shock absorbing media comprises a plurality of weights disposed in a floating, spaced apart relation within the cavity. In other embodiments, a link flexibly interconnects the plurality of weights.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a shock absorption and transferring appendage for a shovel blade. As stated above, roadbed fissures and potholes can be caused by the rupturing or cracking of pavement due to excess energy between the vertical and horizontal movements of a shovel on or towards the ground when there is water in, excess stress on, or a small fissure already present in the roadbed.

The shock absorbing and energy transferring appendage of the present invention is a mechanical device designed to absorb the excess energy or shock between a pavement or roadway surface and the leading edge 24 of a shovel in order to decrease the impact and shear forces against the roadway, leading to the creation of small fissures or larger potholes.

While there are many methods of shock absorption and many shovels used in snow plows today, the shock absorbing and transferring appendage according to the present invention is the only invention that applies a shock absorption technology to the edge of a shovel in a solution that allows the retrofitting of existing shovel and snowplow blades. The shock absorbing and transferring appendage also directly absorbs minor shock at the point of contact between the shovel and the road rather than through connections between the shovel and the apparatus managing the shovel.

Figure 1:
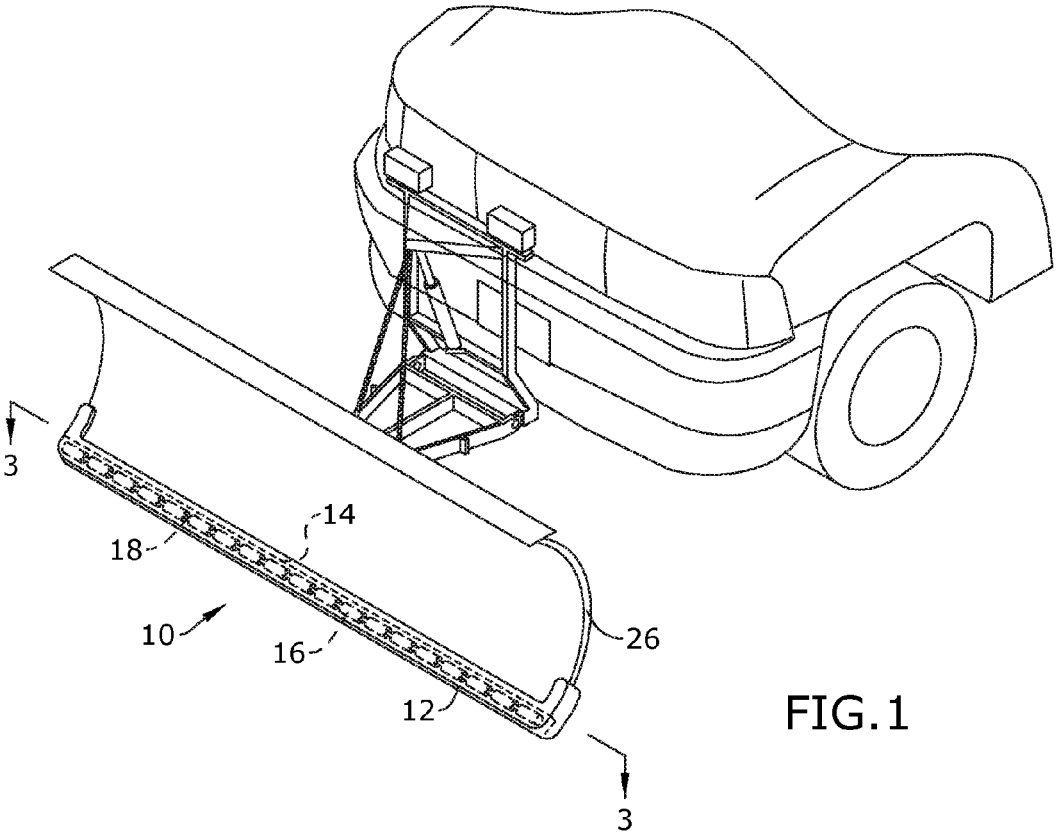
FIG. 1 is a perspective view of an exemplary embodiment of the invention, shown in use.
Figure 2:
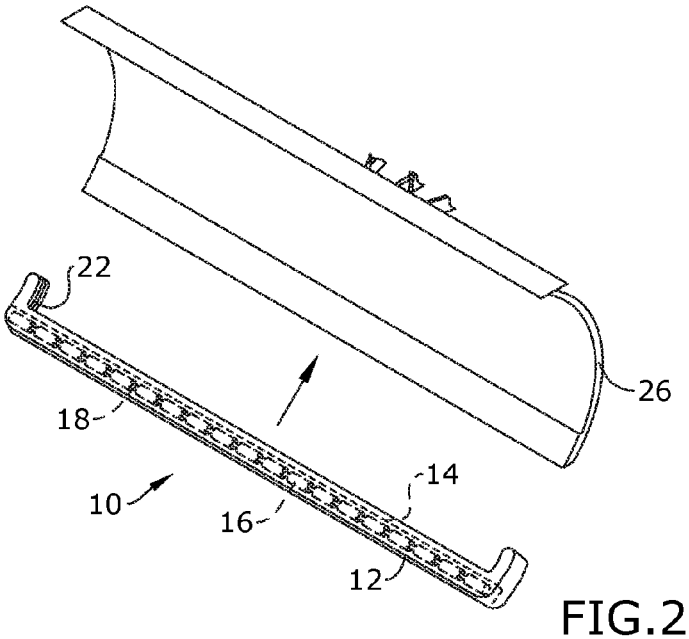
FIG. 2 is a perspective view of an exemplary embodiment of the invention, showing placement of appendage 10 onto plow edge 22.

As seen in reference to FIG. 1, the shock absorbing and transferring appendage 10 is operatively attached to the leading edge 24 of a shovel blade 26. The shovel blade may be attached to the bumper and/or frame member of a motor vehicle, or alternatively, the leading handcart shovel shown in FIG. 5, or any shovel blade.

The shock absorbing and transferring appendage 10 is attached to the shovel blade 26, via suitable fasteners, such as bolts, rivets, welds, or high strength adhesives. The appendage 10 may be attached to the shovel blade 26 via a flange extending from the appendage. The appendage 10 may also include an attachment slot 22, or channel, which may be defined between two flanges, extending along a longitudinal length of the housing 12. The appendage 10 may also include an extension on opposed ends of the appendage 10 in which the attachment slot 22 extends upwardly and may receive the lateral edges of the shovel blade 26.

The appendage 10 of the present invention includes a housing 12, having a cavity 14 defined therein along a linear length of the housing 12. The housing may be formed of any suitable resilient durable material, such as galvanized rubber, a metallic mesh, a blended material or other material. A plurality of weights 16 are retained in the cavity 14. The plurality of weights 16 are contained within the cavity 14 in a loose fitting arrangement, such that they are free floating, that is they are able to move, or be deflected within the cavity when acted upon by a force. Preferably, the plurality of weights 16 are interconnected to one another via a plurality of links 18. The weights 16 and links 18 facilitate the absorbing and distribution of kinetic energy encountered by the appendage 10.

The weights 16 and links 18 may be formed from a metal, a composite, or like material. The weight, diameter, and length of the weights 16 and interconnecting links 18 are selected based on the intended application for the appendage 10. For example a large highway snow plow 26, would be substantially larger and heavier than those for the small handcart push shovel 38, shown in FIG. 5.

Figure 5:
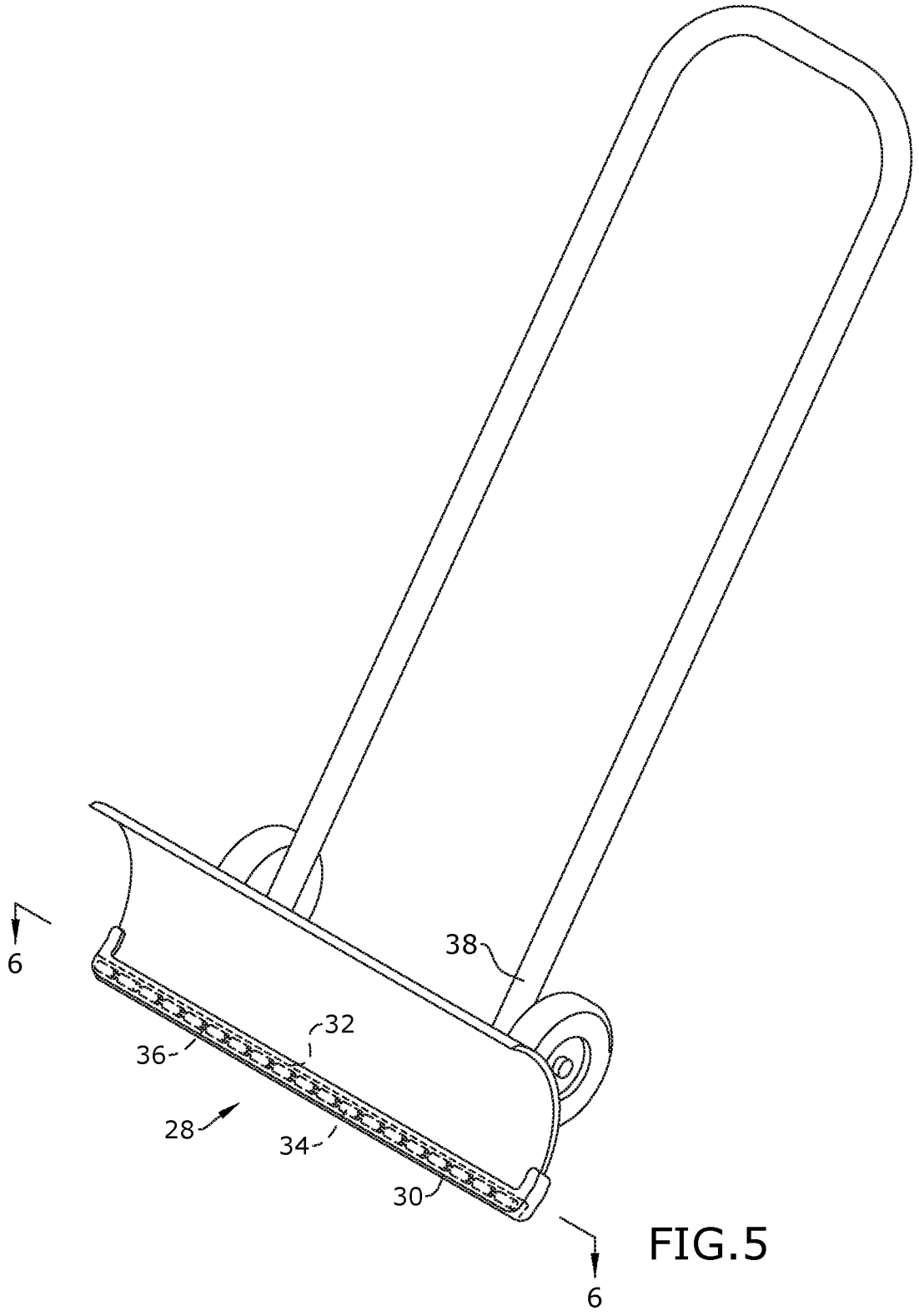
FIG. 5 is a perspective view of an alternate embodiment of the invention, shown in use.
Figure 6:
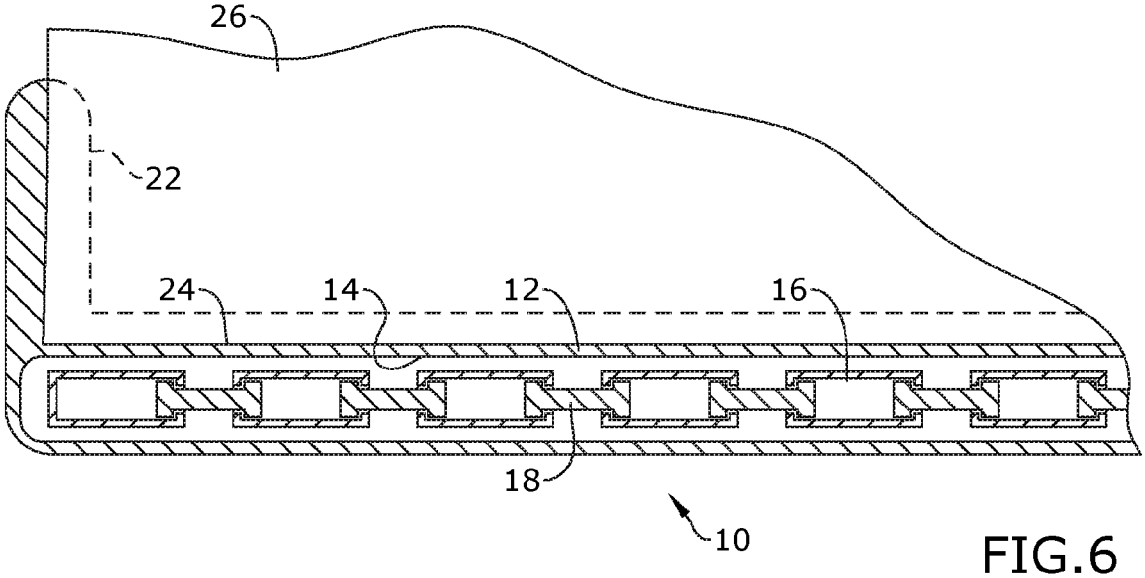
FIG. 6 is a section view of the invention, taken along line 6-6 is FIG. 5, shown with the option of not using interlink media 20.

The push shovel shown in FIG. 5 illustrates the similarities of the components of the appendage 10 which are adapted a smaller application. The appendage 28 includes a housing 30 having a cavity 32 defined therein. The weights 34 are smaller in diameter and length than those for the larger shovel appendage 10. Similarly, the links 36 interconnect the weights 34.

In one embodiment of the invention, the weights 16 may comprise a hollow end portion which may captively retain a protrusion on the end of the link 18 retained therein. Optionally, the weights 16 may be hollow and may have openings slightly less in diameter than the interior. The links 18 may have anchors at each end that are slightly larger in diameter than the anchor. The difference in diameters will create a link between the flexible conduit 18 and the weight 16 creating a chain for which to absorb and disperse shocks encountered with the roadway.

Figure 3:
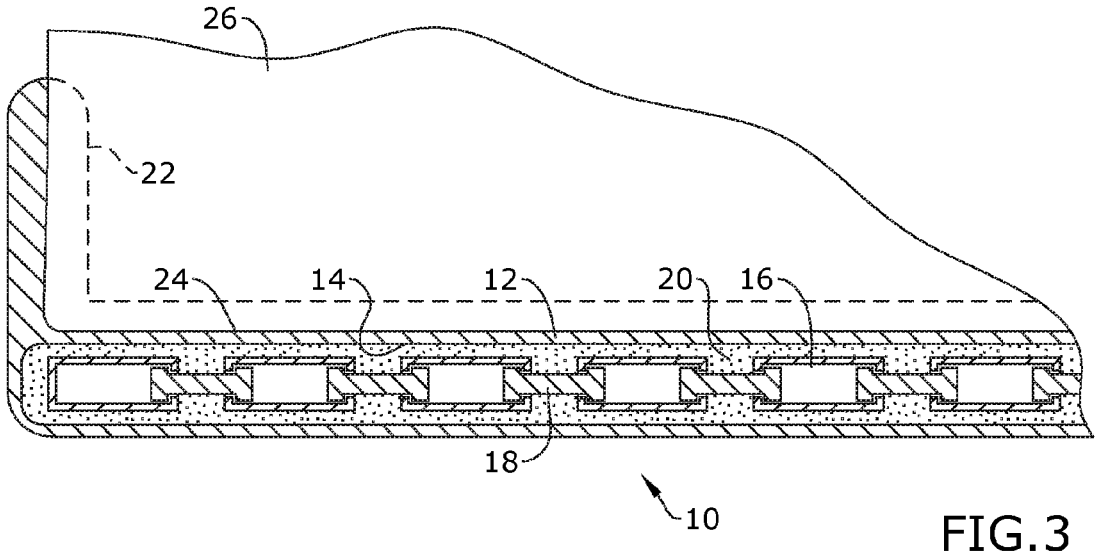
FIG. 3 is a section view of the invention, taken along line 3-3 is FIG. 1.
Figure 4:
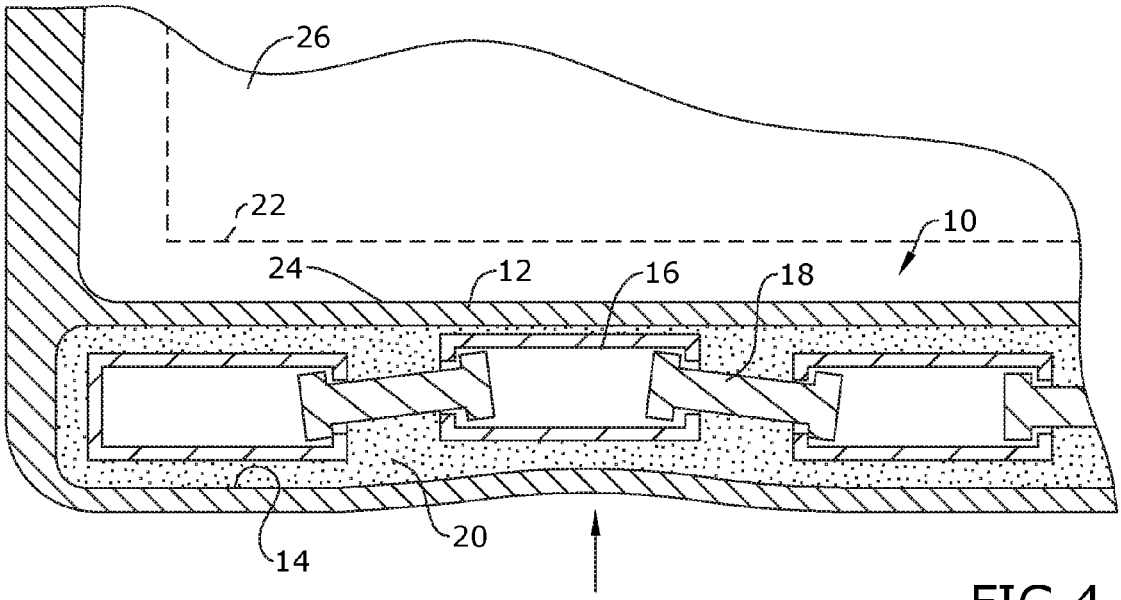
FIG. 4 is a section view of the invention, illustrating the movement of weights 16 and links 18 when housing 12 encounters force.

As may be best seen in reference to FIGS. 3 and 4, the intra-cavity space 14 that is not occupied by the weights 16 and links 18 may be filled by an interlink media 20. The interlink media may be formed of a viscous fluid, sand, crushed walnut shells, pelletized materials, and the like. The interlink media is not required to form the main apparatus but can be applied for additional shock absorption.

Referring now to FIG. 4, when a disturbance or pressure from the roadway surface strikes the tip of a shovel 26, protected with the appendage 10 of the present invention, (indicated by the arrow), the kinetic energy or shock of the fluctuation of terrain hitting the shovel 26 will be dispersed via the housing 12 and distributed along the weights 16 via the links 18 of the shock absorbing link 18. As will be appreciated, in certain preferred embodiments the displacement of the interlink media 20 may also absorb an amount of kinetic energy as well.

As will be appreciated, the appendage 10 of the present invention may be employed by retrofitting old or existing shovels. A person would need to provide the size and usage type of the shovel. Using this information, such as the amount of wear and road types, we could then produce a custom appendage to be added to the shovel. The appendage 10 may also be utilized by adding it to a newly manufactured shovel 16. The shovel manufacturer would indicate the intended usage of the shovel and an appendage would be produced for that.

The appendage 10 could be added to any blade that goes over uneven terrain. Variants could be used for low to the ground cars or trailers.

It should be understood, of course, that the foregoing relates to exemplary embodiments of the invention and that modifications may be made without departing from the spirit and scope of the invention as set forth in the following claims.

What is claimed is:

1. An impact absorbing appendage for a shovel blade, comprising:

an elongate housing coupled to a leading edge of the shovel blade, the elongate housing having a cavity defined therein;

a plurality of weights disposed within said cavity; and a plurality of links interconnecting said plurality of weights.

2. The impact absorbing appendage of claim 1, further comprising:

a channel defined in an outer surface of the elongate housing and extending along a longitudinal length of the housing.

3. The impact absorbing appendage of claim 2 further comprising:

an appendage extension at a first end and a second end of the elongate housing, extending upwardly from the elongate housing.

4. The impact absorbing appendage of claim 3, wherein the channel extends from the elongate housing along an inward face of the appendage extension.

5. The impact absorbing appendage of claim 1, further comprising:

a flange extending from an outer surface of the elongate housing and extending along a longitudinal length of the housing.

6. The impact absorbing appendage of claim 1, further comprising:

an interlink media contained within said cavity.

7. The impact absorbing appendage of claim 6, wherein said interlink media comprises one of: a viscous fluid, a granular, a crushed, or a pelletized solid material.

8. An impact absorbing apparatus for a shovel blade, comprising:

an elongate housing having a cavity defined therein;

a shock absorbing media contained within said cavity;

an attachment flange extending along a longitudinal length of the appendage.

9. The impact absorbing apparatus of claim 8, wherein the attachment flange defines a channel extending along the longitudinal length of the appendage.

10. The impact absorbing apparatus of claim 9, wherein the shock absorbing media comprises a viscous fluid.

11. The impact absorbing apparatus of claim 9, wherein the shock absorbing media comprises one of a granular, a crushed, or a pelletized solid material.

12. The impact absorbing apparatus of claim 9, wherein the elongate housing is formed of a resilient material.

13. The impact absorbing apparatus of claim 12, further comprising a fastener securing the elongate housing to the shovel blade.

14. The impact absorbing apparatus of claim 8, wherein the shock absorbing media comprises:

a plurality of weights disposed in a spaced apart relation within said cavity along a longitudinal length of the elongate housing.

15. The impact absorbing apparatus of claim 14, further comprising:

a plurality of links flexibly interconnecting the plurality of weights.

16. The impact absorbing apparatus of claim 15, further comprising:

a left and a right extension connected with the channel extending along inward opposed faces of the left and the right extensions and adapted to receive a left and a right lateral edge of the shovel blade.

17. An impact absorbing shovel, comprising:

a shovel blade having a leading edge;

an appendage operatively coupled to the leading edge, the appendage comprising, an elongate resilient housing having a cavity defined therein; and a shock absorbing media contained within said cavity.

18. The impact absorbing shovel of claim 17, wherein said shock absorbing media comprises:

a plurality of weights disposed in a floating, spaced apart relation within the cavity; and a link flexibly interconnecting the plurality of weights.

* * * * *